US006429832B1

(12) United States Patent
Harada et al.

(10) Patent No.: US 6,429,832 B1
(45) Date of Patent: Aug. 6, 2002

(54) PLASMA DISPLAY PANEL UNIT

(75) Inventors: Takashi Harada; Toshihide Kuriyama; Yoshizumi Sekii, all of Tokyo (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 09/393,019

(22) Filed: Sep. 9, 1999

(30) Foreign Application Priority Data

Sep. 11, 1998 (JP) ..... 10-257730

(51) Int. Cl.[7] ..... G09G 3/28
(52) U.S. Cl. ..... 345/60; 313/489; 313/492
(58) Field of Search ..... 345/60, 61, 62, 345/63, 41, 76, 87; 313/484, 485, 491, 489, 492

(56) References Cited

U.S. PATENT DOCUMENTS 4,164,678 A 8/1979 Biazzo et al.
6,090,464 A * 7/2000 Yoo ..... 428/73

FOREIGN PATENT DOCUMENTS

| | | |
|---|---|---|
| JP | 5537753 | 3/1980 |
| JP | 63 076232 | 4/1988 |
| JP | 2028690 | 1/1990 |
| JP | 4287397 | 10/1992 |
| JP | 7319424 | 12/1995 |
| JP | 8-55581 | 2/1996 |
| JP | 9-145918 | 6/1997 |
| JP | 9-149346 | 6/1997 |
| JP | 9-172267 | 6/1997 |
| JP | 9269751 | 10/1997 |
| JP | 9-306366 | 11/1997 |
| JP | 10-172444 | 6/1998 |
| JP | 10-214717 | 8/1998 |

* cited by examiner

*Primary Examiner*—Dennis-Doon Chow
(74) *Attorney, Agent, or Firm*—Young & Thompson

(57) ABSTRACT

A plasma display panel (PDP) has a plurality of scanning electrodes and a plurality of common electrodes extending in a row direction, a plurality of data electrodes extending in a column direction, and a ground electrode disposed adjacent to the data electrodes for canceling the electromagnetic radiation from the data electrodes during a write period of the PDP.

7 Claims, 11 Drawing Sheets

PLASMA DISPLAY PANEL UNIT

BACKGROUND OF THE INVENTION (a) Field of the Invention

The present invention relates to a plasma display panel (PDP) unit and, more particularly, to a surface discharge type PDP having a plurality of common electrodes and a plurality of scanning electrodes on a single plane for discharging therebetween.

(b) Description of a Related Art

In general, a PDP has a large number of advantages of smaller thickness, lower flicker, larger contrast, larger display area, quicker response etc., and thus is expected for use as a flat display panel unit in a personal computer system or a workstation system as well as a wall television.

PDPs are categorized by the operational principle thereof into two types: a DC discharge type wherein uninsulated electrodes are exposed to a discharge space (or discharge gas) for operation at a DC voltage; and an AC discharge type wherein electrodes are insulated from the discharge gas by an insulating coat for operation at an AC voltage. The AC discharge type, such as used as a wall television, is further categorized by the operational principle thereof into two types: a memory type using a function of the insulator for storing electric charge in each pixel area (discharge cell); and a refreshing type which does not have a memory function. The brightness or luminance of the PDP is generally proportional to the number of repetitive discharges or the frequency of the driving pulse for the PDP. The present invention relates to any type of PDPs.

FIG. 1 shows a typical configuration of a color PDP, such as described in JP-A-8-55581. The color PDP has a front glass panel 46, a pair of optical filters 48 sandwiching therebetween the front glass panel 46 for absorbing a specified frequency range of the visible light passed by the front glass panel 46, and an electromagnetic filter 47 for absorbing electromagnetic waves radiated from the PDP as well as optical waves, which are disposed at the front side of the color PDP 45.

The described configuration is silent as to the shield for the electromagnetic waves at the rear side of the PDP 45, and thus does not have a desired electromagnetic shield function.

FIG. 2 shows a color PDP unit, such as described in JP-A-9-145918 and -9-149346. The color PDP unit includes a filter 52 including an electromagnetic shield layer at the front side of the PDP 51, wherein the filter 52 has an external terminal 52*a* of the electromagnetic shield layer at the rear side of the filter 52, and the external terminal 52*a* is in electrical contact with a metal fitting 57 used for mounting the PDP 51 at the front frame 53 of the PDP unit. A rear housing 54 of the PDP unit has a plurality of projecting bosses 58 for mounting the PDP 51 at the rear side of the PDP 51. The filter 52 is connected to the ground of the color PDP 51 through the fittings 57, the bosses 55 having a conductive coat thereon, the inner wall of the rear housing 54 and the bosses 58.

Although the described configuration has an electromagnetic shield at both the front and rear sides of the PDP 51 by enclosing the color PDP 51 with the filter 52, the front frame 53 and the rear housing 54, the color PDP unit cannot have an effective shield function if there is malfunction in electric contact between the filter 52 and the frame 53 and between the frame 53 and the housing 54. In addition, even if a sufficient electric contact is achieved between the filter 52 and the ground, a higher level of the electromagnetic radiation is not effectively shielded by the filter 52.

FIG. 3A shows another color PDP unit, such as described in JP-A-9-172267, and FIG. 3B is a sectional view taken along a plane "C" in FIG. 3A. The color PDP unit includes a frame body 61 made of a conductive material such as an aluminum alloy for receiving therein a color PDP 60 and a driving circuit thereof. A rear cover 63 made of plastics is fixed onto the rear side of the frame body 61 by screws 65. A front frame 62 made of plastics is also fixed onto the frame body 61 by way of screws 64. Thus, the PDP unitis shielded from electromagnetic radiation therefrom by the rear cover 63 and the front frame 62.

However, the shield function of the frame body 61, rear cover 63 and the front frame 62 is not sufficient because of the presence of the front opening of the frame body 61 and the front frame 62. Thus, the described configuration cannot provide an effective electromagnetic shield.

JP-A-9-306366 describes a color PDP unit 75 having a filter 70 shown in FIG. 4. The filter 70 is provided for shielding the electromagnetic radiation from the PDP, and includes a filter substrate 71 made of plastic resin added with pigments for selectively absorbing radiation, a reflection-resistant film 74 attached onto a side of the filter substrate 71 far from the PDP, and a silver-sputtered film 72 and an AN film 73 consecutively adhered onto the other side of the filter substrate 71 near the PDP. The silver-sputtered film 72 is made of polyethylene terephthalate (PET) sputtered by silver or inorganic substance, and the AN film 73 has a function for preventing generation of a Newton ring. The silver-sputtered film 72 is connected to the ground for discharging the voltage induced by the electromagnetic radiation.

The described configuration is also silent as to the shield from the electromagnetic radiation at the rear side of the PDP, as in the case of JP-A-8-55581 and thus does not have a sufficient electromagnetic shield function.

As described heretofore, the conventional PDP units generally use an electromagnetic shield by surrounding or enclosing the color PDP with a housing or a filter made of an electromagnetic shield substance. The techniques using the shield substance, however, generally involves higher costs because of the accuracy required in fabrication of the housing or the filter for confinement of the electromagnetic radiation within the housing or an insufficient electromagnetic shield function.

Especially, the electromagnetic shield technique using the housing or filter does not reduce the electromagnetic radiation itself. Thus, even if the electromagnetic shield is effectively performed against electromagnetic radiation from the PDP by some elements, leakage from other elements may be the next problem to be solved, iterating this procedure until a sufficient shield can be obtained as a whole. Thus, a long time and complicated fabrication process may be necessary before a sufficient shield can be obtained against the electromagnetic radiation from the PDP unit.

SUMMARY OF THE INVENTION

It is therefore an object of the present invention to provide a PDP unit having a function for reducing the electromagnetic waves without using a housing or filter made of an electromagnetic shield substance.

The present invention provides a plasma display panel (PDP) unit comprising first and second substrates opposing each other for defining therebetween a plurality of discharge cells, a plurality of first electrodes each disposed on the first substrate to extend in a row direction, a plurality of second electrodes each disposed on a first surface of the second substrate to extend in a column direction, and a first means for canceling an electromagnetic radiation from the second electrodes.

It is preferable for the first means to cancel the electromagnetic radiation from the second electrodes at least by six decibels.

In accordance with the PDP unit of the present invention, since the electromagnetic radiation from the second electrodes can be cancelled by the first means, a high-performance filter or an expensive housing is not necessary in the PDP unit, thereby reducing the costs of the PDP unit in reducing the electromagnetic radiation from the PDP unit.

PREFERRED EMBODIMENTS OF THE INVENTION

Now, the present invention is more specifically described with reference to accompanying drawings.

Figure 1:
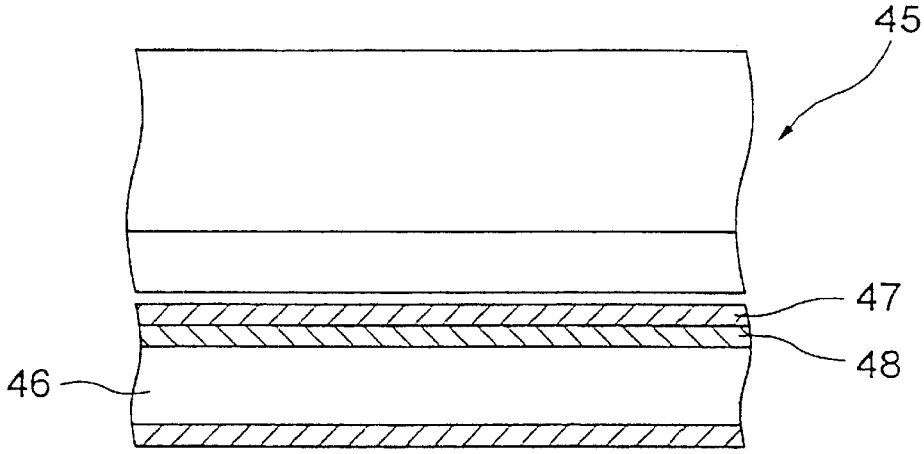
FIG. 1 PRIOR ART
FIG. 1 is a sectional view of a conventional color PDP.
Figure 2:
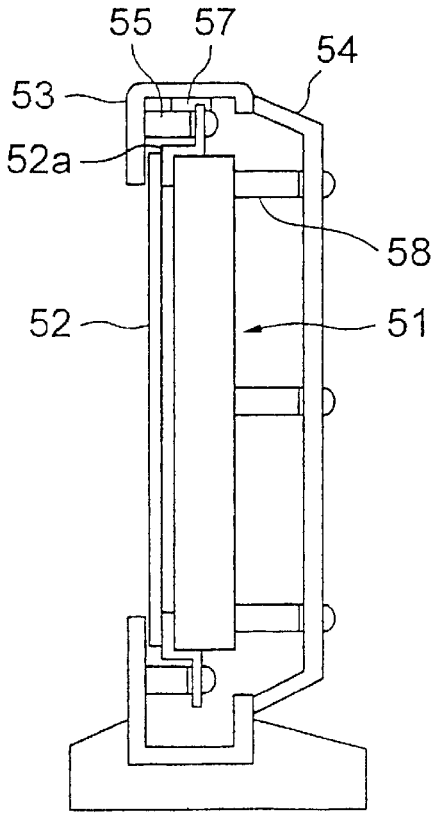
FIG. 2 PRIOR ART
FIG. 2 is a vertical-sectional view of a conventional color PDP unit.
Figure 3A:
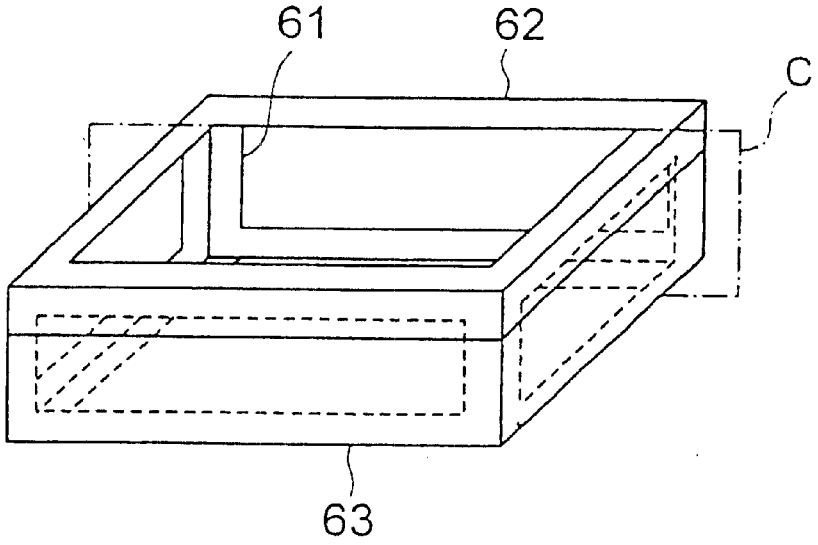
FIG. 3A PRIOR ART
FIG. 3A is a perspective view of another conventional color PDP unit.
Figure 3B:
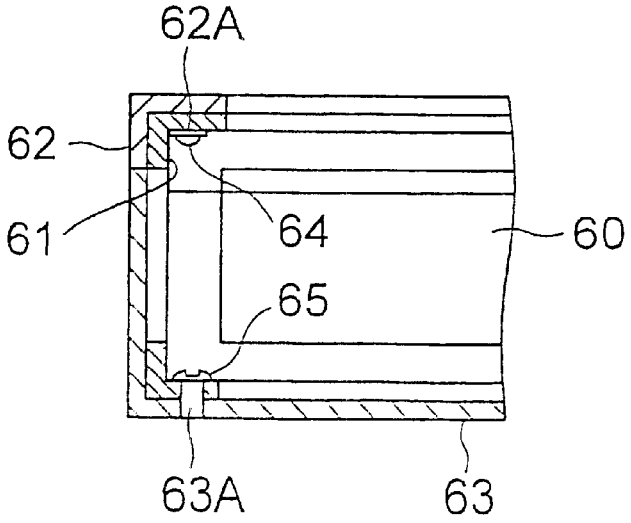
FIG. 3B PRIOR ART
FIG. 3B is a sectional view taken along a plane "C" in FIG. 3A.
Figure 4:
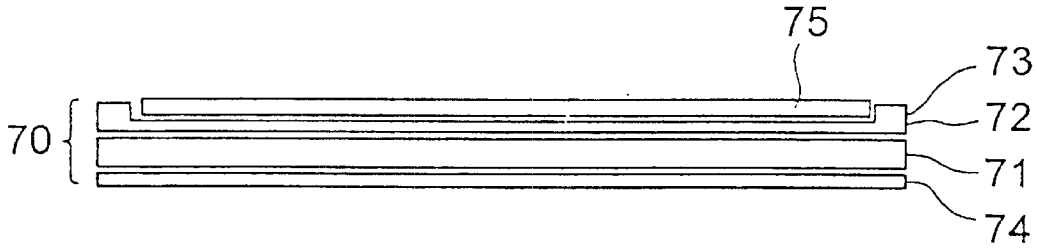
FIG. 4 PRIOR ART
FIG. 4 is a sectional view of another conventional color PDP unit.
Figure 5:
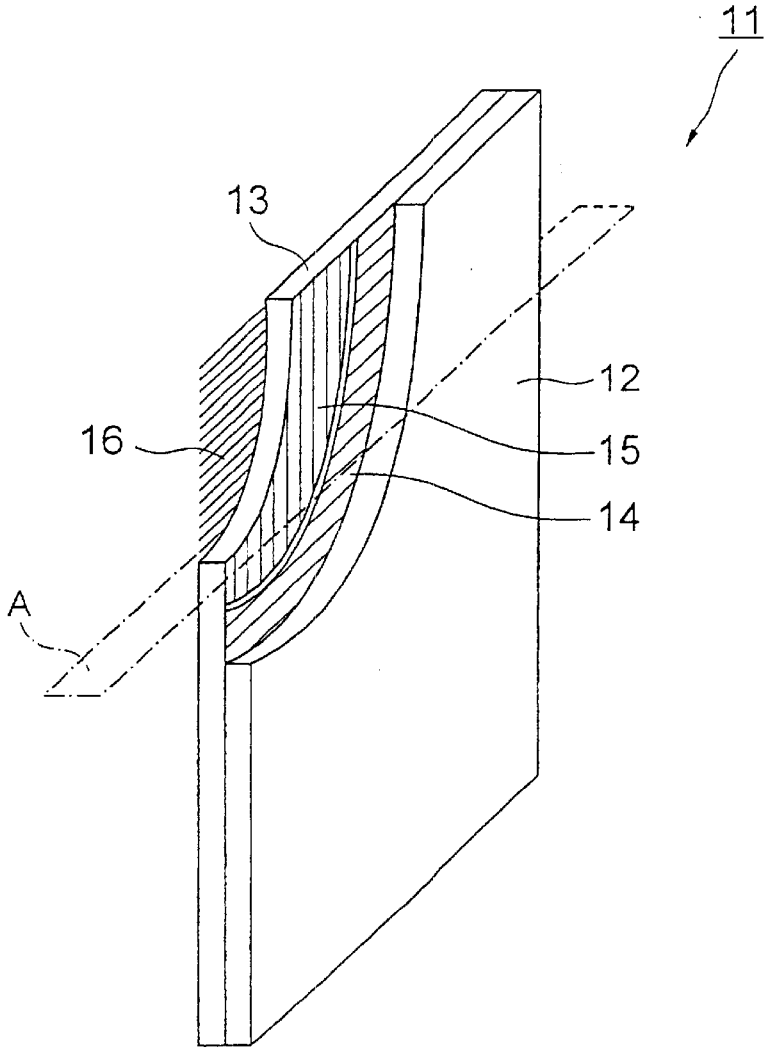
FIG. 5 is a partially-broken perspective view of a color PDP according to a first embodiment of the present invention.
Figure 6:
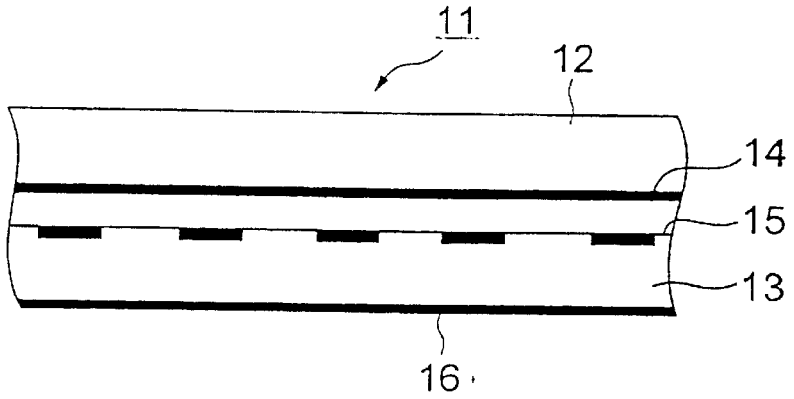
FIG. 6 is a sectional view of the color PDP of FIG. 5 taken along a plane "A" in FIG. 5.

Referring to FIGS. 5 and 6, a color PDP 11 according to a first embodiment of the present invention includes a pair of glass (transparent) substrates including a front substrate 12 and a rear substrate 13 opposing each other for defining therebetween a plurality of discharge cells. The front substrate 12 has a plurality of row electrodes 14 extending in a row (horizontal) direction on one of the surfaces of the front substrate 12 near the rear substrate 13. The row electrodes 14 includes a plurality of scanning electrodes and a plurality of common electrodes forming a plurality of electrode pairs each for effecting electric discharge in each discharge cell. The rear substrate 13 has a plurality of data electrodes or column electrodes 15 each extending on one of the surfaces of the rear substrate 13 near the front substrate 12 in the column (vertical) direction, to store a memory for effecting discharge in specified discharge cells in the corresponding column. The rear substrate 13 also has a planar ground electrode 16 on the other surface of the rear substrate 13 far from the front substrate 12.

By the configuration of the present embodiment, suppression of electromagnetic radiation from the data electrodes 15 can be achieved by the ground electrode 16. The ground electrode 16 need not be connected to the ground, although it is preferable to connect the ground electrode 16 to the ground because a higher suppression efficiency of electromagnetic radiation can be obtained thereby. The ground electrode 16, the data electrodes 15, the scanning electrodes 14 and the common electrode 14 may be made of the same conductive material or different conductive materials. The ground electrode 16 may be formed as a conductive sheet such as a copper sheet or a sputtered metallic film.

Figure 7:
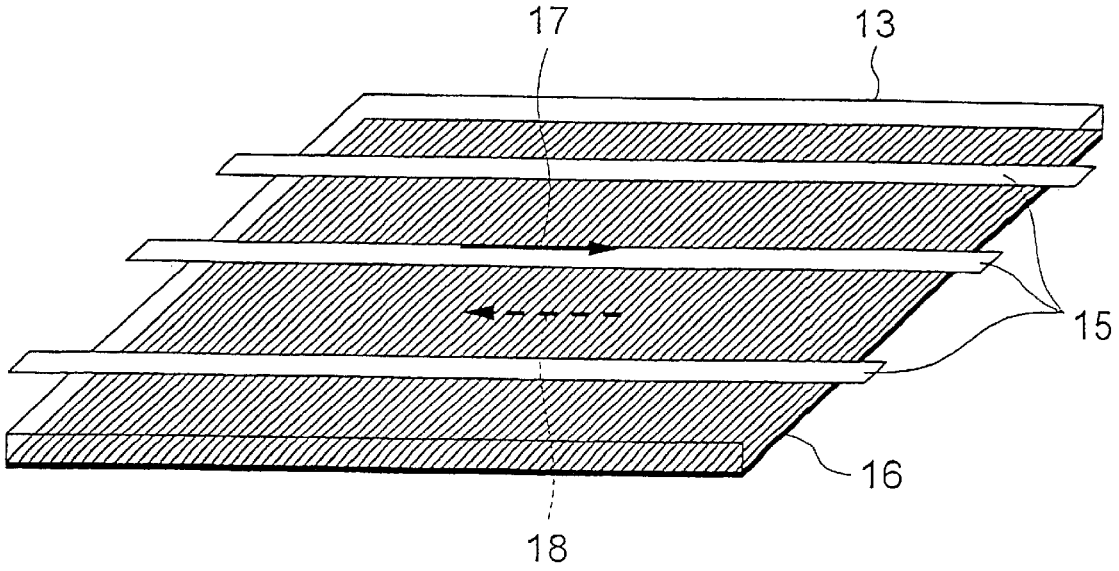
FIG. 7 is a perspective view of the color PDP of FIG. 5 for showing operation of the PDP.

Referring to FIG. 7, there is shown a perspective view of the arrangement of the electrodes in the PDP 11 of the present embodiment. The electromagnetic radiation from the PDP 11, especially from the data electrodes 15, generally assumes a maximum in a write period of the PDP 11 for writing display data in each display cell, wherein a high-frequency current or drive current 17 flows through the data electrode 15 to radiate an electromagnetic wave.

The ground electrode 16, as disposed in the vicinity of the data electrodes 15, allows a mirror-image current 18 of the high-frequency current 17 to pass through the ground electrode 16 by a mirror image effect. The image current 18 in the ground electrode 16 flows in the direction opposite to the direction of the high-frequency current 17 on the data electrode 17, and thus generates an electromagnetic radiation which has an opposite phase with respect to the phase of the electromagnetic radiation from the high-frequency current 17, thereby canceling the electromagnetic radiation from the high-frequency current 17. The function of the cancellation of the electromagnetic radiation by the ground electrode 16 is increased by connecting the ground electrode 16 to the ground of the driving circuit of the PDP 11. A smaller thickness of the rear substrate 13 is preferable because it increases the image current 18 and further suppresses the electromagnetic radiation from the data electrode 17.

Figure 8:
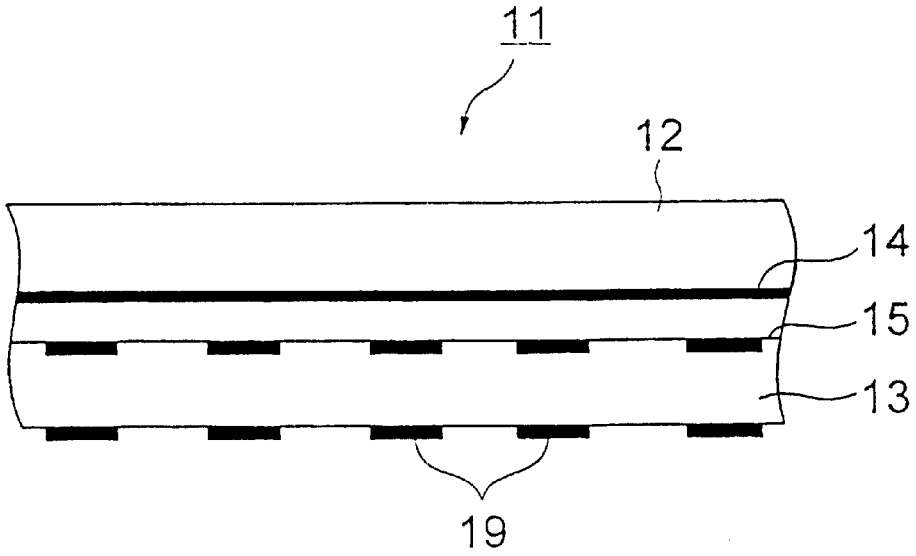
FIG. 8 is a sectional view of a color PDP according to a second embodiment of the present invention.

Referring to FIG. 8, a PDP 11 according to a second embodiment of the present invention is similar to the first embodiment except for a plurality of ground electrodes 19 extending parallel to one another in the present embodiment. Each ground electrode 19 extends parallel to and opposing the corresponding data electrode 15 with the rear substrate 13 disposed therebetween. Each ground electrode 19 has a width substantially equal to or slightly larger than the width of the data electrode 15. The ground electrode 19 allows a mirror-image current of the high-frequency current to flow through the ground electrode 19, as in the case of the first embodiment, thereby canceling the electromagnetic radiation from the high-frequency current.

Each ground electrode 19 may have any configuration so long as it extends parallel to the corresponding data electrode 15 and has a low resistance. It is preferable, however, that the ground electrode 19 is of a stripe shape having a width substantially equal to or slightly larger than the width of the data electrode 15 for an effective cancellation of the electromagnetic radiation.

Figure 9:
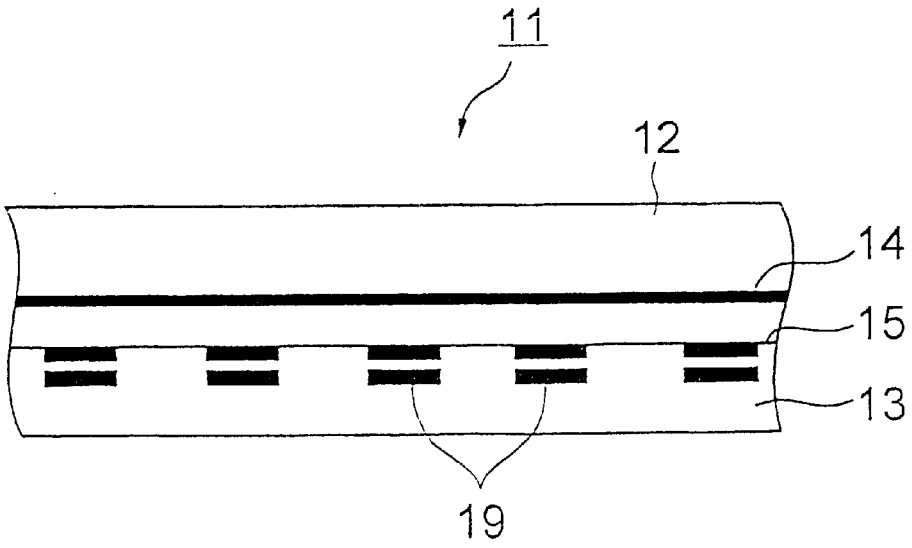
FIG. 9 is a sectional view of a color PDP modified from the second embodiment.

It is preferable that the distance between the data electrode 15 and the corresponding ground electrode 19 be as small as possible. FIG. 9 shows a modification from the configuration of FIG. 8, the modification including embedded ground electrodes 19 each embedded just below the corresponding data electrode 15 in the side of the rear substrate 13 same as the side mounting thereon the data electrode 15.

Figure 10:
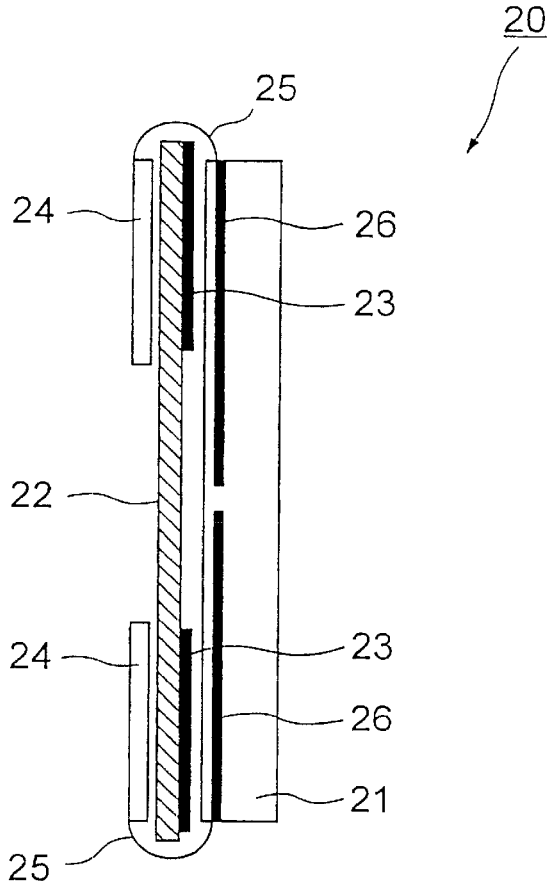
FIG. 10 is a sectional view of a color PDP unit according to a third embodiment of the present invention.

Referring to FIG. 10, a color PDP unit 20 according to a third embodiment of the present invention includes a PDP 21, a drive circuit board 24 for driving the data electrodes 26 in the PDP 21 through a flexible cable 25, and a ground board 22 disposed between the PDP 21 and the drive circuit board 24. The data electrodes 26 are separated in the column direction at the central area of the PDP 21. The ground board 22 has a magnetic layer 23 in the peripheral region of the surface of the ground board 22 near the data electrodes 26. A high-frequency signal is generated in a write period by the drive circuit board 24 to be stored in the data electrodes 26 via the flexible cable 25 from the drive circuit board 24. In a modification, the magnetic layer 23 may be disposed on the entire surface of the ground board 22.

Figure 11:
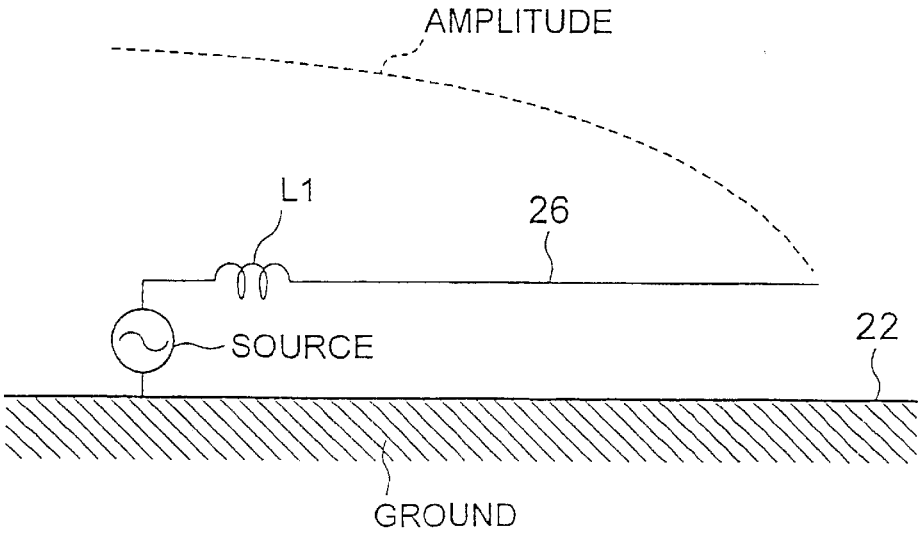
FIG. 11 is a schematic sectional view of the PDP unit of FIG. 10 for showing operation thereof.

FIG. 11 shows a schematic diagram illustrating the high-frequency current flowing on the data electrode 26 of the PDP 21 in FIG. 10 during a write period. Since each data electrode 26 generally has an open distal end, the high-frequency current on the data electrode 26 has a largest amplitude on the proximal end thereof at which the drive voltage is supplied, and has a smaller amplitude toward the distal end, as schematically illustrated by dotted line in FIG. 11. The portion of the data electrode 26 at which the high-frequency current has a larger amplitude is applied with a magnetic field by the magnetic layer 23. The magnetic layer 23, such as made of ferrite, located in the vicinity of that portion functions as an equivalent inductance (L1) connected in series with the data electrode 26. Accordingly, the impedance as viewed from the electric source of the drive circuit board 24 toward the data electrode 26 in the high-frequency range is increased by the presence of the magnetic layer 23, which suppresses the high-frequency current and the electromagnetic radiation therefrom. If the magnetic layer 23 has a power loss, the data electrode 26 includes an equivalent resistance as well as the equivalent inductance, which converts the energy of the high-frequency current to a heat loss, thereby further suppressing the electromagnetic radiation.

Figure 12:
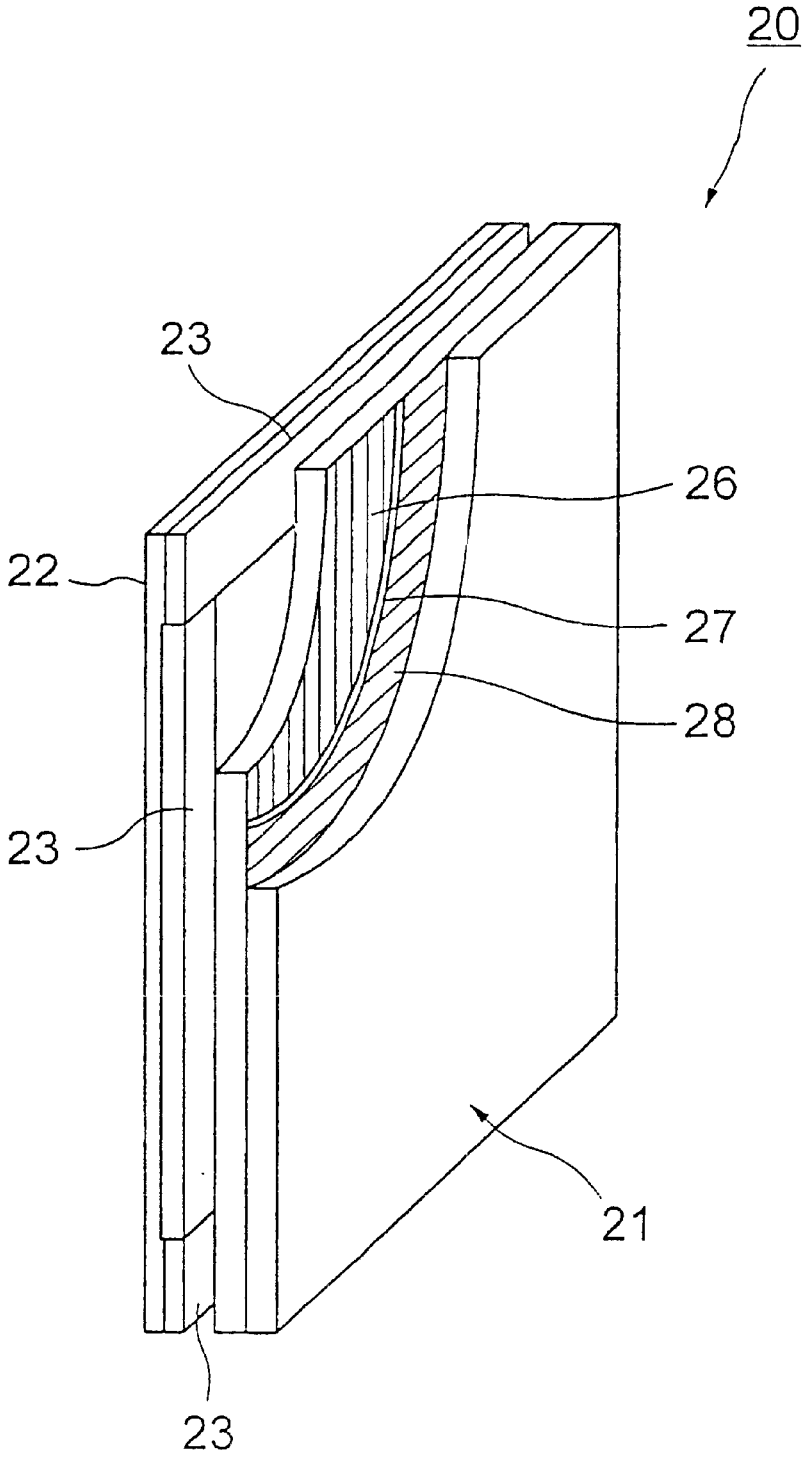
FIG. 12 is a partially-broken perspective view of the color PDP unit of FIG. 10.

Referring to FIG. 12 showing the PDP unit of the present embodiment in a perspective view, the magnetic layer 23 is disposed in the peripheral area of the ground board 22, or, top, bottom, right and left sides of the ground board 22. The right side of the magnetic layer 23 disposed in the vicinity of the portion of the scanning electrode 27 at which the scanning voltage is input suppresses the electromagnetic radiation from the scanning electrode 27. The left side of the magnetic layer 23 disposed in the vicinity of the portion of the common electrode 28 at which the common voltage is input suppresses the electromagnetic radiation from the common electrode 28. In short, the magnetic layer 23 suppresses electromagnetic radiation from the data electrodes 26, scanning electrodes 27 and the common electrodes 28.

Figure 13:
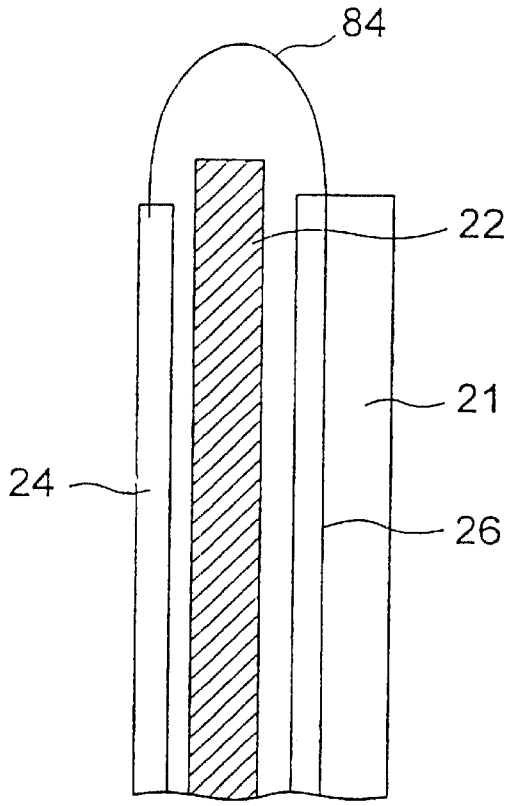
FIG. 13 is a sectional view of a color PDP unit according to a fourth embodiment of the present invention.

Referring to FIG. 13, a PDP unit according to a fourth embodiment of the present invention includes a color PDP 21 having a plurality of data electrodes 26, a drive circuit board 24 for driving the PDP 21, and a ground board 22 disposed between the data electrodes 26 and the drive circuit board 24. The data electrodes 26 and the drive circuit board 24 are connected by a flexible cable 84 at the tops of the data electrodes 26 and the drive circuit electrode 24 for supplying driving voltages from the drive circuit board 24 to the data electrodes 26.

Figure 14:
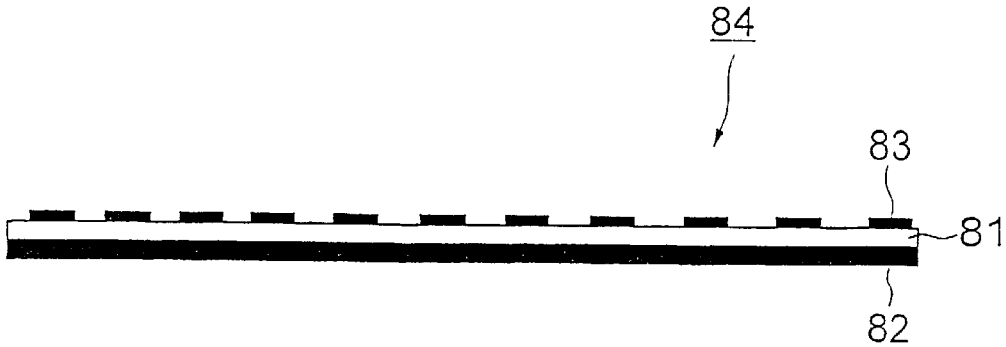
FIG. 14 is a sectional view of the cable shown in FIG. 13.

Referring to FIG. 14, the flexible cable 84, as viewed in the direction perpendicular to the extending direction of the flexible cable 84, is of a planar shape and a flexible structure, and includes a ground layer 82, a magnetic layer 81 formed on the ground layer 82, and a plurality of signal lines 83 extending parallel to one another on the magnetic layer 81. The ground layer 82 is electrically connected to the ground board 22 through the ground line of the drive circuit board 24. An overcoat layer may be formed on the flexible cable 84 for reinforcement thereof.

In the above configuration of the present embodiment, the magnetic layer 81 of the flexible cable 84, disposed in the vicinity of the drive circuit board 24 having a higher amplitude of the driving current, functions as an equivalent inductance connected in series with the data electrodes 26, similarly to the configuration shown in FIG. 11. Thus, the impedance as viewed from the electric source toward the data electrode 26 in the high-frequency region is increased, thereby suppressing the electromagnetic radiation. If the magnetic layer 81 has a power loss, the data electrode 26 has an equivalent resistance as well as the equivalent inductance to further suppress the electromagnetic radiation.

Figure 15:
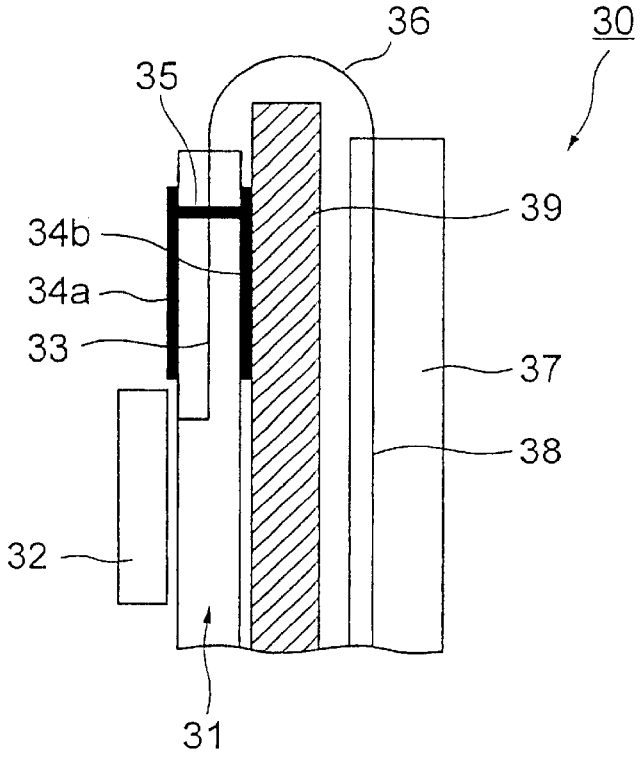
FIG. 15 is a sectional view of a color PDP unit according to a fifth embodiment of the present invention.

Referring to FIG. 15, a PDP unit 30 according to a fifth embodiment of the present invention includes a drive IC 32 mounted on a drive IC board 31, a PDP 37 having a plurality of data electrodes 38, and a ground board 39 disposed between the drive IC board 31 and the PDP 37.

The drive IC board 31 includes a circuit pattern 33 formed within the drive IC board 31, a first ground layer 34*a* formed on the upper half of the rear surface of the IC board 31, and a second ground layer 34*b* formed on the upper half of the front surface of the drive IC board 31. The drive IC 32 is fixed onto the lower half of the rear surface of the drive IC board 31.

Figure 16:
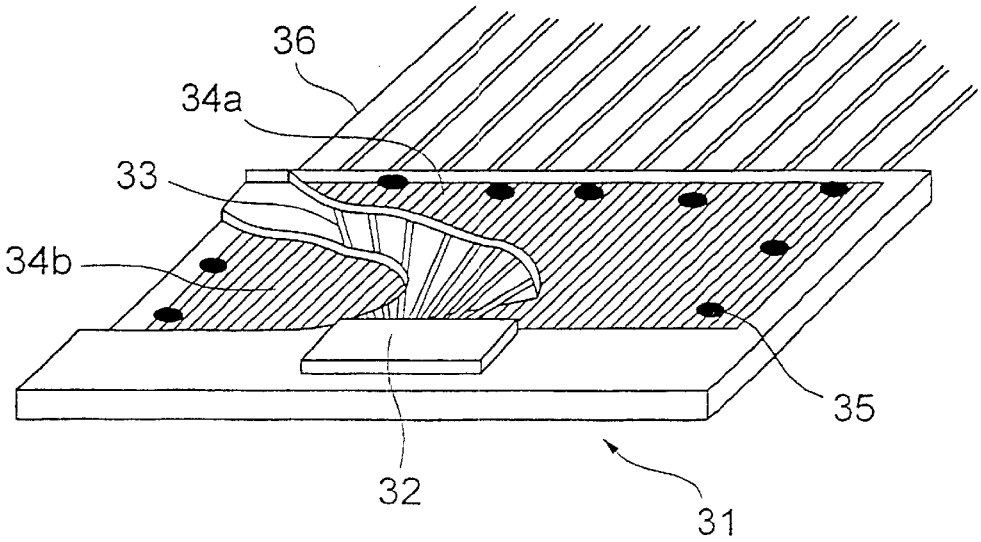
FIG. 16 is a partially-broken perspective view of the electrode substrate in the color PDP unit of FIG. 15.

Referring to FIG. 16, the drive IC board 31 is formed as a multilayer printed circuit board including three or more layers. The drive IC board 31 transfers write signals and discharge voltage from the drive IC 32 to the data electrodes 38 via the flexible cable 36. The circuit pattern 33 is interposed between the first ground layer 34*a* and the second ground layer 34*b*. Both the ground layers 34*a* and 34*b* are connected together through a plurality of through-holes 35 located at the positions where the circuit pattern 33 does not include signal lines. One or both of the ground layers 34*a* and 34*b* is connected to the ground of the color PDP 37.

Figure 17:
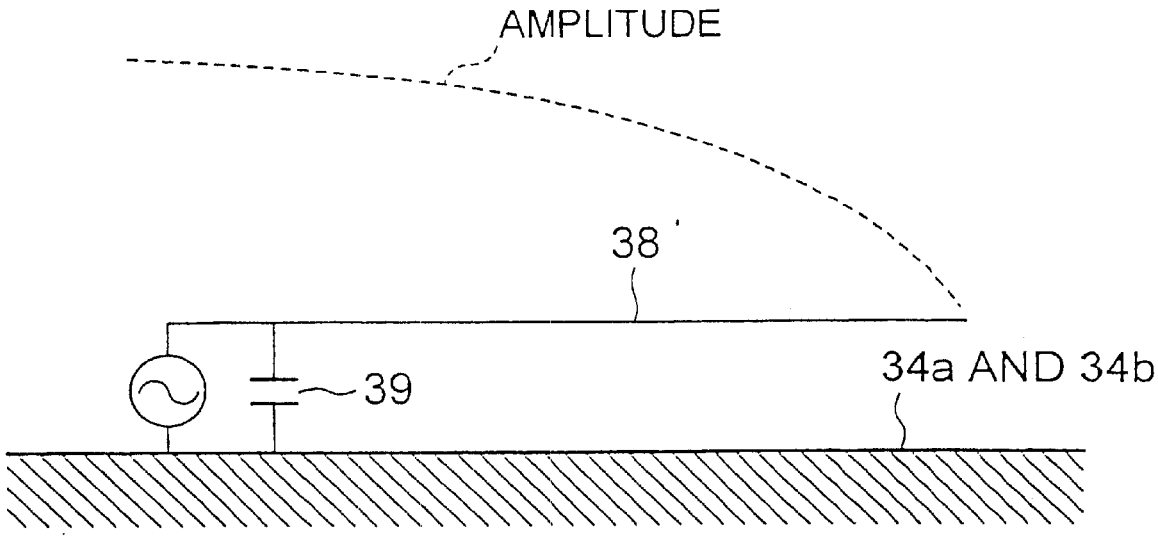
FIG. 17 is a schematic sectional view of the color PDP unit of FIG. 15.

Referring to FIG. 17 showing the amplitude of the high-frequency current in the present embodiment similarly to FIG. 11, the data electrode 38 has a large parasitic capacitance 39 between the same and the pair of ground layers 34*a* and 34*b*, because the circuit pattern 33 connected to the data electrode 38 is sandwiched between the ground layers 34*a* and 34*b*. The large parasitic capacitance 39 reduces the high-frequency current flowing into the data electrode 38 by bypassing the high-frequency current toward the ground layers 34*a* and 34*b*, thereby reducing the electromagnetic radiation from the data electrode 38.

The configuration of the ground layers 34*a* and 34*b* can also reduce the high-frequency current flowing into the scanning electrodes and the common electrode, as in the case of the third embodiment.

Figure 18A:
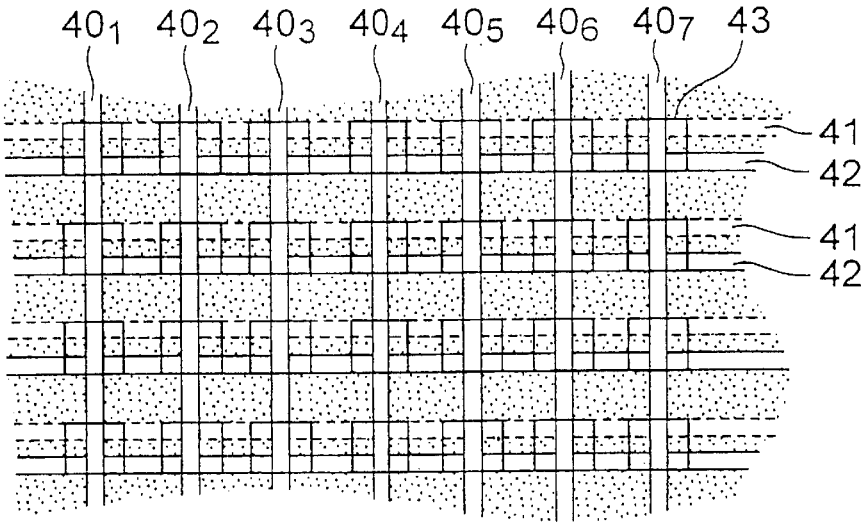
FIG. 18A is top plan view of the data electrodes in a color PDP unit according to a sixth embodiment of the present invention.

Referring to FIG. 18A, a color PDP unit according to a sixth embodiment of the present invention includes a plurality of scanning electrodes 41 and a plurality of common electrodes 42, which extend in the row direction, and a plurality of data electrodes $\mathbf{40}_1$, $\mathbf{40}_2$, $\mathbf{40}_3$, $\mathbf{40}_4$, . . . which extends in the column direction. Each pair of scanning electrode 41 and common electrode 42 crosses each data electrode 40 to define a pixel area 43 or discharge cell of the PDP for effecting electric discharge in the pixel area, whereby a plurality pixel areas are arranged in a matrix.

Figure 18B:
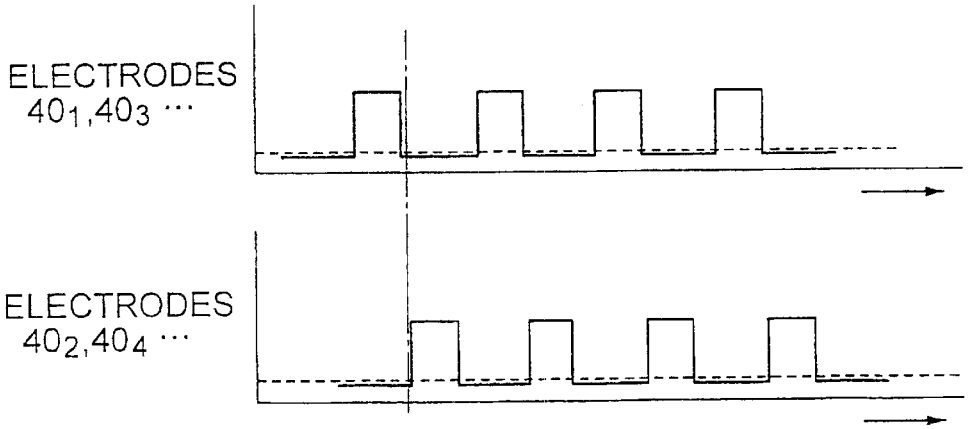
FIG. 18B is a timing chart of the driving pulses for the data electrodes of FIG. 18A.

The data electrodes include a plurality of odd-numbered electrodes $\mathbf{40}_1$, $\mathbf{40}_3$, . . . and a plurality of even-numbered electrodes $\mathbf{40}_2$, $\mathbf{40}_4$, . . . alternately driven by the drive circuit. More specifically, in a write period of the PDP, as shown in FIG. 18B, odd-numbered data electrodes $\mathbf{40}_1$, $\mathbf{40}_3$, . . . are applied with a drive voltage when the even-numbered data electrodes $\mathbf{40}_2$, $\mathbf{40}_4$, . . . are maintained at the ground level, and also maintained at the ground level when the even-numbered data electrodes $\mathbf{40}_2$, $\mathbf{40}_4$, . . . are applied with the drive voltage.

In the write period, one of the scanning electrodes 41 is applied with a negative voltage, while the data electrodes corresponding to the specified pixel areas are applied with a positive voltage for conducting electric discharge in the specified pixel areas for image display in the next display period. The scanning electrodes 41 are scanned in the order of arrangement, with the specified data electrodes 40 being applied with a positive voltage for writing data in each pixel area. After the data are stored in all the specified pixel areas in the write period, a display discharge is conducted in the next display period for the specified pixel areas by applying a display voltage between all the scanning electrodes 41 and all the common electrodes 42.

The even-numbered data electrodes $\mathbf{40}_2$, $\mathbf{40}_4$, . . . , maintained at the ground potential when the odd-numbered data electrodes $\mathbf{40}_1$, $\mathbf{40}_3$, . . . are applied with a positive voltage, allow image current of the high-frequency current to flow therethrough, thereby canceling the electromagnetic radiation from the odd-numbered electrodes. On the other hand, the odd-numbered data electrodes, maintained at the ground potential when the even-numbered data electrodes are applied with a positive voltage, allow image currents of the high-frequency currents to flow therethrough, thereby canceling the electromagnetic radiation from the even-numbered data electrodes.

In a modification of the above embodiment, the data electrodes may have any number of groups or any order of groups so long as the image current flowing into some data electrodes cancels radiation from the high-frequency current flowing into other data electrodes by desired decibels. For example, every three consecutive data electrodes may form separate groups.

As described above, in the above embodiments, since the electromagnetic radiation can be canceled or reduced by the image current of the high-frequency current, the PDP unit of the present invention need not have a high-performance electromagnetic filter or an expensive housing for enclosing the PDP. The function of the image current or the drive circuit for canceling the electromagnetic radiation may be such that the image current or the drive circuit reduces the electromagnetic radiation by at least six decibels. A reasonable electromagnetic filter or housing may be provided to cooperate with the configuration of the present invention for further reducing the electromagnetic radiation.

Since the above embodiments are described only for examples, the present invention is not limited to the above embodiments and various modifications or alterations can be easily made therefrom by those skilled in the art without departing from the scope of the present invention.

What is claimed is:

1. A plasma display panel (PDP) unit comprising:

first and second substrates opposing each other for defining therebetween a plurality of discharge cells;

a plurality of first electrodes each disposed on said first substrate to extend in a row direction;

a plurality of second electrodes each disposed on a first surface of said second substrate to extend in a column direction; and a ground electrode maintained at a ground potential for generating therein a mirror-image current of a drive current flowing in said second electrodes for canceling an electromagnetic radiation at least from said second electrodes.

2. The PDP unit as defined in claim 1, wherein said ground electrode is disposed on an substantially entire surface of said second substrate other than said first surface.

3. The PDP unit as defined in claim 1, wherein said ground electrode includes a plurality of electrode stripes each extending parallel to a corresponding one of said second electrodes.

4. The PDP unit as defined in claim 3, wherein said electrode stripes are embedded in said second substrate.

5. The PDP unit as defined in claim 1, wherein said ground electrode includes a ground board, and a magnetic layer mounted by said ground board at a peripheral area thereof.

6. The PDP unit as defined in claim 1, further comprising a cable for driving said second electrodes therethrough, said cable including a ground layer maintained at ground potential, a magnetic layer formed on said ground layer, and a plurality of signal lines formed on said magnetic layer for driving said second electrodes.

7. The PDP unit as defined in claim 1, wherein said electromagnetic radiation is cancelled by six decibels or more.

* * * * *